US009228349B2

(12) United States Patent
Kim et al.

(10) Patent No.: US 9,228,349 B2
(45) Date of Patent: Jan. 5, 2016

(54) FIRE-RESISTANCE ENHANCING METHOD FOR THE HIGH STRENGTH CONCRETE STRUCTURE

(71) Applicant: KOREA INSTITUTE OF CONSTRUCTION TECHNOLOGY, Gyeonggi-Do (KR)

(72) Inventors: Heung-Youl Kim, Seoul (KR); Hyung-Jun Kim, Gyeonggi-Do (KR); In-Hwan Yeo, Seoul (KR); Bum-Yean Cho, Seoul (KR); Jong-Uk Song, Gyeonggi-Do (KR); Dae-Bong Ju, Gyeonggi-Do (KR)

(73) Assignee: KOREA INSTITUTE OF CONSTRUCTION TECHNOLOGY, Gyeonggi-Do (KR)

( * ) Notice: Subject to any disclaimer, the term of this patent is extended or adjusted under 35 U.S.C. 154(b) by 134 days.

(21) Appl. No.: 14/019,206

(22) Filed: Sep. 5, 2013

(65) Prior Publication Data

US 2014/0068946 A1 Mar. 13, 2014

(30) Foreign Application Priority Data

Sep. 13, 2012 (KR) ..... 10-2012-0101782

(51) Int. Cl.

| | |
|---|---|
| ***E04C 5/18*** | (2006.01) |
| ***E04C 5/01*** | (2006.01) |
| *B28B 23/04* | (2006.01) |

(52) U.S. Cl.

CPC ..... *E04C 5/012* (2013.01); *B28B 23/04* (2013.01); *Y10T 29/49632* (2015.01)

(58) Field of Classification Search

CPC ..... E04C 5/012; E04C 5/01; E04C 5/16; E04C 5/18; E04C 5/0604; E04C 3/20; E04C 3/205; E04C 3/29; E04C 3/293; E04C 3/34; E04H 17/10; B28B 23/046; B28B 3/04

USPC ..... 52/649.1–649.4

See application file for complete search history.

(56) References Cited

U.S. PATENT DOCUMENTS

| | | | | |
|---|---|---|---|---|
| 1,499,984 A * | 7/1924 | Heidrich | ..... | 52/687 |
| 1,538,293 A * | 5/1925 | Loyeau | ..... | 52/600 |
| 5,119,614 A * | 6/1992 | Rex | ..... | 52/649.3 |
| 5,367,854 A * | 11/1994 | Kim | ..... | 52/745.13 |
| 6,293,071 B1 * | 9/2001 | Konstantinidis | ..... | 52/659 |

OTHER PUBLICATIONS

Andrew Budek, "Seismic Performance of a Grout-repaired Construction Defect in Column Plastic Hinge", The Arabian Journal for Science and Engineering, Jun. 2006, pp. 179-192, vol. 31, No. 1C.

* cited by examiner

*Primary Examiner* — Sarang Afzali
*Assistant Examiner* — Jun Yoo
(74) *Attorney, Agent, or Firm* — J.C. Patents

(57) ABSTRACT

Disclosed is a method of enhancing fire resistance of high-strength concrete by mixing a spalling reducer (fiber cocktail) into the concrete to control spalling and performing shear reinforcement of main steel bars using shear stiffeners based on a wire rope and spacers.

7 Claims, 12 Drawing Sheets

| Conceptual view of fiber mixture | Conceptual view of main steelbar confinement of wire rope |
|---|---|
|  |  |

| Unapplied technology | Applied technology (fiber mixture + wire rope transverse confinement) |
|---|---|
|  |  |

FIRE-RESISTANCE ENHANCING METHOD FOR THE HIGH STRENGTH CONCRETE STRUCTURE

CROSS-REFERENCE TO RELATED APPLICATION

This application claims the priority benefit of Korean patent application serial no. 10-2012-0101782, filed on Sep. 13, 2012. The entirety of the above-mentioned patent application is hereby incorporated by reference herein and made a part of this specification.

BACKGROUND

1. Field of the Invention

The present invention relates to a method of enhancing fire resistance of high-strength concrete by mixing a spalling reducer (fiber cocktail) that is a hybrid of a polypropylene fiber and a steel fiber into the concrete and performing proof stress reinforcement (transverse confinement) on main steel bars using a wire rope and spacers.

2. Discussion of Related Art

As the height of buildings increases, the strength of concrete increases. Due to the recent technological development of high-strength concrete, there is increased need of a spalling prevention method as a plan for ensuring fire safety performance of a high-strength concrete column applied to a super high-rise building when a big fire breaks out, as well as a plan for improving load bearing capacity.

The high-strength concrete has characteristics of lower permeability and higher density than ordinary concrete. When exposed to high temperature, the high-strength concrete undergoes spalling due to thermal stress caused by a temperature difference between the interior and exterior of the high-strength concrete and a sharp increase in pore pressure of the interior of the high-strength concrete. For this reason, to ensure structural fire safety of super high-rise buildings to which the high-strength concrete is applied, a composite technique for preventing spalling and simultaneously improving load bearing capacity is required.

In general, to prevent spalling, a sharp rise in temperature should be suppressed, and a moisture content of the concrete should be equal to and less than a range of 5 to 6%. Further, a ratio of water to cement should be maintained at a adequate level. However, these requirements are merely minimum requirements for preventing spalling. To prevent spalling of the high-strength concrete applied to high-rise buildings, additional countermeasures based on a mechanism by which spalling takes place are studied in addition to such basic requirements.

Spalling of concrete advances in a primary spalling process in which the concrete is exposed to high temperature and is accompanied by an exfoliation phenomenon caused within 20 minutes by surface expansion, and secondary and tertiary spalling processes caused by an increase in vapor pressure of pores. Due to a loss of dynamic behavior capability of main bars in the primary spalling process, and a loss of a cross-section in the secondary and tertiary spalling processes, the building may collapse.

Known spalling prevention methods based on a spalling mechanism include a method of applying fireproof paint, a method of using polypropylene and metal lath, a method of applying a fireproof board, and a method of using a mixture of polypropylene and steel fibers.

First, the method of applying fireproof paint has an advantage in that construction is easy while a surface temperature can be controlled, but a disadvantage in that proof stress can be sharply reduced due to separation of a foamable material when a fire breaks out.

Next, the method of using polypropylene and metal lath has an advantage in that scattering caused by spalling can be reduced, but a disadvantage in that securing of concrete fluidity (coagulation of polypropylene that is organic fiber) and quality control are difficult.

Here, polypropylene (a kind of organic fiber, and called PP fiber) is melted when internal temperature of concrete continues to increase during a fire, thereby forming a microstructure serving as a passage through which vapor can be discharged. The metal lath is a kind of metal mesh that is installed for traverse confinement of steel bars arranged in the concrete.

Next, the method of applying a fireproof board has an advantage in that heated temperature can be controlled, but a disadvantage in that an effective space is reduced due to an increase in cross-section of a member.

The method of using a mixture of polypropylene and steel fibers has an advantage in that compressive strength is increased due to an increase in tensile strength due to the steel fiber, but a disadvantage in that securing of fluidity and quality control are also difficult.

In addition, the higher the strength of high-strength concrete, the smaller the size of a pore contributing to discharge of vapor. There is a disadvantage in that there is a limit in preventing spalling based on a method of mixing in the organic fiber.

Further, the existing method of applying fireproof paint mentioned above emphasizes prevention of spalling, but both the prevention of spalling and securing of load bearing capacity are required because actual columns are load-bearing members.

Particularly, the fiber (e.g. polypropylene fiber) mixing method has an advantage in that spalling can be prevented by facilitating discharge of vapor through pores secured by a low melting point in the event of a fire, but a problem in that the load bearing capacity can be significantly reduced by pores generated when the fiber melts in a fire.

Therefore, when the fiber mixing construction method is applied as a method of controlling spalling of a high-strength concrete column, a method capable of securing the load bearing capacity should always be applied. Otherwise, fire resistance of the high-strength concrete column applied to super high-rise buildings cannot be secured.

Here, the conventional metal lath is used as a means for confining steel bars. However, there is a limit in securing the load bearing capacity of the high-strength concrete column using only the metal lath such as the steel mesh. Further, there are problems in that constructability is low and there is no alternative but to be limited to concrete pouring in the long run.

FIG. 1*a* shows an example of a conventional column structure reinforced by wire ropes 20.

That is, main steel bars 10 are arranged inside a column structure in a vertical direction. In place of conventional shear steel bars (transverse reinforcing bars or stirrups), wire ropes 20 wind the main steel bars 10, and opposite ends thereof are connected by fasteners 30. Spacers 40 are supported inside the main steel bars 10.

However, the wire ropes 20 are vertically spaced apart from each other around the main steel bars one by one. Consequently, it can be found that one shear steel bar is reinforced by one wire rope 20. In this main steel bar reinforcement, the wire rope arranging method for securing fire resistance is not separately disclosed.

FIG. 1*b* shows an example of conventional construction of a spiral shear reinforcement (formed of a reinforcing fiber and a resin) 50. It can be found that this spiral shear reinforcement is continuously disposed along main steel bars in a spiral pattern in a vertical direction, but the wire rope arranging method for securing fire resistance is not separately disclosed.

SUMMARY OF THE INVENTION

However, when the fiber mixing method (e.g. polypropylene fiber) mainly used as the existing spalling prevention method is applied to the high-strength concrete column to which the load is applied, this may serve as a major cause of abrupt brittle fracture due to generated pores. Accordingly, the present invention is directed to a method of enhancing fire resistance of high-strength concrete by mixing a spalling reducer (fiber cocktail) into the concrete in order to control spalling and simultaneously performing shear reinforcement of main steel bars using shear stiffeners based on a wire rope and spacers.

To achieve the object, first, the present invention replaces conventional stirrups with a wire rope based on a test. The wire rope is easily handled due to a thin piano wire form and is easily disposed in a spiral shape because it winds around main steel bars and gives tensile strength.

Here, when the stirrups are used for the main steel bars, this has a transverse reinforcement effect of the main steel bars, but the main steel bars are not reinforced between the stirrups. As such, the concrete between the stirrups leaves much room for brittle fracture (at a portion at which no stirrups are arranged) due to spalling.

That is, when a given portion of a reinforced concrete structure such as a column structure undergoes brittle fracture due to fire, there is a possibility of the entire column structure effectively collapsing. Thus, a very narrow spacing may be set between the stirrups. In this case, economic efficiency is considerably reduced, which is not advantageous.

Accordingly, the present invention uses the wire rope in place of the stirrups. The wire rope has a thin piano wire form, is easy to work with, and is very easy to wind around the main steel bars in a spiral shape.

While conventional art discloses use of such a wire rope to reinforce the main steel bars in a composite spiral shape, the wire rope is vertically arranged along the main steel bars and has no effect on the prevention of spalling. The wire rope is partly wound in a spiral shape and does not effectively reinforce the main steel bars in between the wire rope.

Typically, steel bars may be machined, but it is very difficult to arrange the steel bars on the main steel bars in a desired shape such as a spiral shape. As such, there is no alternative but to use a reinforced fiber rather than the steel bars. A spiral shear stiffener based on the reinforced fiber is merely spirally disposed at given intervals in a vertical direction, which may be regarded as an arrangement method that has no effect of preventing spalling.

For this reason, the present invention is designed to maximize the effect of preventing spalling in the event of a fire by continuously winding the wire rope around the main steel bars of a column structure which are vertical steel bars in a spiral shape in a vertical direction so as to range from 100 to 140 turns, and setting a vertically disposed spacing to about (2/3)L, where L is a spacing between conventional stirrups, to perform shear reinforcement of the main steel bars with the wire rope.

Further, although a polypropylene (PP) fiber and a steel fiber may be mixed into the concrete of a conventional column structure made of high-strength concrete, a problem with this mixture is fluidity of the poured concrete. To solve this problem of fluidity, the present invention is designed to add a superplasticizer of 6 kg/m$^3$ to 14 kg/m$^3$ in construction methods according to embodiments of the present invention.

Further, in the construction methods according to embodiments of the present invention, the polypropylene fiber of the high-strength concrete is designed to be mixed in at a concentration of 1.4 kg/m$^3$ to 1.6 kg/m$^3$.

Further, in the construction methods according to embodiments of the present invention, the steel fiber of the high-strength concrete is designed to be mixed in at a concentration of 35 kg/m$^3$ to 45 kg/m$^3$.

Further, in the construction methods according to embodiments of the present invention, the polypropylene fiber is designed to be mixed in such a manner that two polypropylene fibers having different diameters are mixed in at a mixing ratio of 7:3 to 5:5.

Further, in the construction methods according to embodiments of the present invention, the reinforced concrete structure is designed to have tie bars arranged in upper and lower sections thereof, each of which occupies (1/5)L of a net section L, and the wire rope is wound in a remaining intermediate section (3/5)L thereof.

According to the present invention, it is possible to effectively enhance the fire resistance of high-strength concrete by improving the fire resistance based on spalling reducer and improving the structural performance of the main steel bars of the concrete structure based on the wire rope and the spacers. Thus, in a high-strength concrete region, it is possible to provide concrete having a stable structure in the event of a fire.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1A:
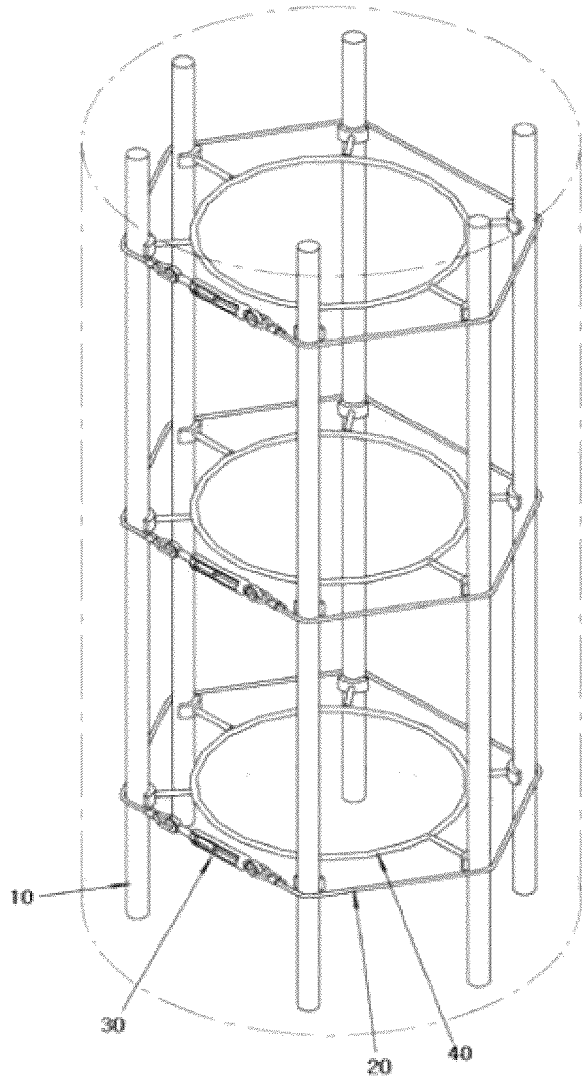
FIG. 1*a* is a view showing how to reinforce main steel bars using wire ropes in the conventional art.
Figure 1B:
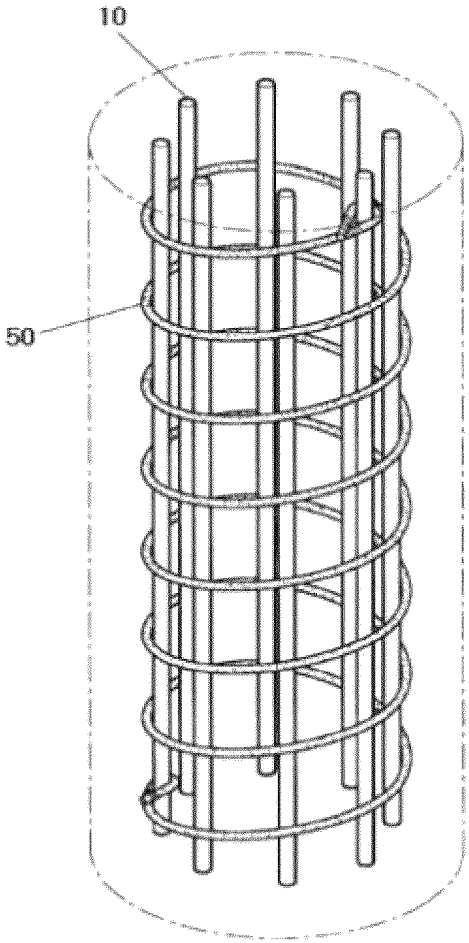
FIG. 1*b* is a view showing how to reinforce main steel bars using a spiral shear stiffener in the conventional art.

Exemplary embodiments of the present invention will be described in detail below with reference to the accompanying drawings. While the present invention is shown and described in connection with exemplary embodiments thereof, it will be apparent to those skilled in the art that various modifications can be made without departing from the spirit and scope of the invention.

For the sake of clarity and concision, technical matters not central to the present invention will not be described. Throughout the appended drawings and the description, parts that appear in more than one drawing or are mentioned in more than place in the description are consistently denoted by the same respective reference numerals.

Figure 2:
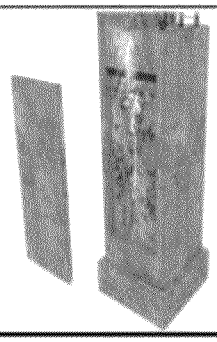
FIG. 2 is a conceptual view of the present invention.
Figure 2:
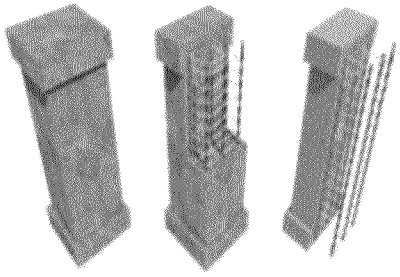
Figure 2:
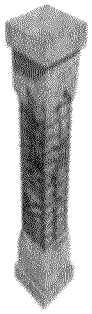
Figure 2:
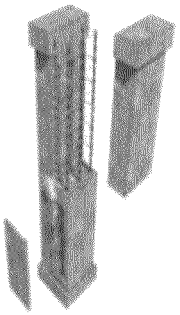

The present invention suggests a method of improving fire resistance of high-strength concrete by mixing a walling reducer (fiber cocktail) hybridizing a polypropylene fiber and a steel fiber as in FIG. 2 into the high-strength concrete and using a main steel bar reinforcement using wire ropes and spacers (fiber cocktail plus wire rope transverse confinement).

The polypropylene fiber (PP fiber) forms micro channels (pores) in the concrete due to a low melting point of 170° C., thereby helping effectively reduce vapor and pore pressures of the concrete to minimize the occurrence of spalling.

When the steel fiber is additionally mixed in, it reduces the occurrence of cracks in a high-strength concrete member after the polypropylene fiber is melted (due to a tensile strength of the steel fiber) and blocks heat penetration from the outside.

Particularly, when the fiber cocktail, i.e. the polypropylene fiber and the steel fiber, is used as a fireproofing mixture for the high-strength concrete vulnerable to spalling (because the high-strength concrete has a very high moisture content), it can be found that this helps to secure fire resistance.

Further, mixing ratios of the high-strength concrete are given in Table 1 below.

plasticizer); and PP and Steel indicate a PP fiber and a steel fiber (hybrid).

The high-strength concrete may indicate concrete whose compressive strength is equal to or greater than 40 MPa. The maximum compressive strength with which this high-strength concrete can be manufactured by a concrete mixer at a current technical level is 60 MPa. High-strength concrete having a maximum compressive strength of 100 MPa cannot be manufactured by the concrete mixer but can be manufactured in a laboratory. The constituent materials themselves are not different from one another, but each constituent material for securing desired compressive strength may be adequately changed.

In the present invention, an important factor associated with the high-strength concrete is a superplasticizer. The superplasticizer is added to the high-strength concrete in order to secure fluidity of the high-strength concrete, because the fluidity of the high-strength concrete is considerably reduced by the fiber cocktail (the hybrid of the PP fiber and the steel fiber) mixed into the high-strength concrete for fire resistance.

The problem is how much the fluidity should be secured in the high-strength concrete of 40 MPa or more in order to obtain an optimal mixture.

For this reason, in the present invention, the superplasticizer is designed to be mixed within a range of 6 kg/m$^3$ to 14 kg/m$^3$. The reason is that, as a result of testing the fluidity after ready-mixed concrete is made, the fluidity is not secured when the superplasticizer is mixed in at a concentration of 6 kg/m$^3$ or less, and a maximum mixing amount for securing fluidity is 14 kg/m$^3$. When the superplasticizer is mixed in at a concentration of 14 kg/m$^3$ or more, the fluidity can be secured. However, since a manufacturing cost including a material cost is increased, the mixing range of the superplasticizer in the present invention is limited to the range of 6 kg/m$^3$ to 14 kg/m$^3$.

Here, a mixing amount of the PP fiber in the high-strength concrete may range from 1.4 kg/m$^3$ to 1.6 kg/m$^3$, and a mixing amount of the steel fiber may range from 35 kg/m$^3$ to 45 kg/m$^3$.

Further, the PP fiber may be used by mixing two fibers, and a mixing ratio used for the mixture is adequately adjusted within a range of 7:3 to 5:5. As an example, Fiber-1 (having a length of 10 mm, a diameter (denier) of 5, and a percentage of 30%) and Fiber-2 (having a length of 5 mm, a diameter (denier) of 3, and a percentage of 70%) are mixed within the range of the mixing ratio.

TABLE 1

| | | W/B | S/a | Air | Unit weight of material (kg/m$^3$) | | | | | | | Ad. | Fiber kg/m$^3$ | |
|---|---|---|---|---|---|---|---|---|---|---|---|---|---|---|
| | | (wt %) | (vol %) | (wt %) | W | C | Slag | F/A | S/F | S | G | (kg/m$^3$) | PP | Steel |
| 60 MPa | Unmixed | 26.2 | 46.0 | 2.0 | 165 | 572 | 163 | 82 | 0 | 639 | 759 | 8.19 | 0 | 0 |
| | Mixed | 26.2 | 46.0 | 2.0 | 165 | 572 | 163 | 82 | 0 | 639 | 759 | 9.45 | 1.5 | 40 |
| 100 MPa | Unmixed | 19.1 | 41.5 | 2.0 | 156 | 400 | 286 | 82 | 49 | 571 | 814 | 10.62 | 0 | 0 |
| | Mixed | 19.1 | 41.5 | 2.0 | 156 | 400 | 286 | 82 | 49 | 571 | 814 | 13.07 | 1.5 | 40 |

In Table 1, "unmixed" and "mixed" indicate a case in which the fiber cocktail is not used and a case in which the fiber cocktail is used; W/B indicates a percentage of a binder (cement) based on water; S/a indicates a percentage of a sand volume based on an aggregate volume; Air indicates a volume of air; W indicates water; C indicates cement; Slag indicate (blast furnace) slag; F/A indicates fly ash; S/F indicates silica fume; S indicates sand; G indicates gravel; Ad. indicates advanced air-entrained (AE) water reducing agent (super- The reason is that, when the fibers have the same diameter, a phenomenon in which the fibers conglomerate when mixed is increased, and simultaneously the discharge of vapor is inefficient because the pores formed in the event of a fire are constant in size.

When only a fiber mixing method is applied to a high-strength concrete column, test results comparing the fire resistance in an unloaded state of the column (structure) with that in a loaded state are given as in Table 2 below.

TABLE 2

| | Strength | Method | Load (ton) | Fire resistance (min) | Results of testing fire resistance: Highest temperature (° C.) | Shrinkage | Strain |
|---|---|---|---|---|---|---|---|
| Loaded fire resistance test | 100 MPa | Fiber mixing | 850 | 10 | — | 32.2 mm | 29.7 mm |
| Unloaded fire resistance test | | | 0 | 180 | 627 | — | — |

The fire resistance test was performed on a 100 MPa high-strength concrete column to which the fiber mixing method is applied, and the loaded fire resistance test was performed according to a KS testing method based on KS F 2257-1. Brittle fracture of the column occurred due to a sharp pore increase caused by fiber mixture and buckling of middle steel bars caused by a load. The unloaded fire resistance test was performed according to an unloaded fire resistance testing method based on No. 2008-334 announced by The Ministry of Land, Infrastructure and Transport of Korea and showed that a fire resistance of 180 minutes could be secured in the case of the fiber mixing method.

Here, actual columns are structural members supporting a load. The column in the unloaded state cannot be applied to a building. As such, to serve as the column member in the loaded state, a fiber mixing method for preventing spalling in the event of a fire, a technique for preventing buckling of main steel bars, and a technique for improving proof stress of the column member should be applied at the same time.

Therefore, to secure a fire resistance of the loaded high-strength concrete column, a spalling prevention method based on the fiber mixture and a method of securing the load bearing capacity based on the transverse reinforcement of the main steel bars should be applied at the same time. Otherwise, the fire safety of the column applied to a high-rise building cannot be guaranteed.

Accordingly, in the present invention, the main steel bars of a reinforced concrete structure are shear-reinforced to prevent buckling of the main steel bars using support spacers along with a transverse reinforcement arrangement using wire ropes.

A means for preventing the spacing between the main steel bars from being changed by the wire ropes tightening around the main steel bars, keeping the spacing between the main steel bars constant, and preventing buckling of the main steel bars is a support spacer 200 of the present invention.

Figure 3:
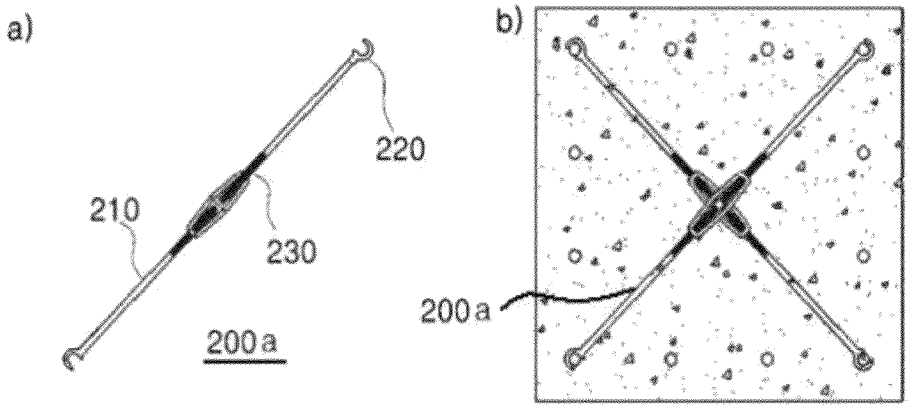
FIGS. 3 and 4 show a support spacer according to an embodiment of the present invention.
Figure 4:
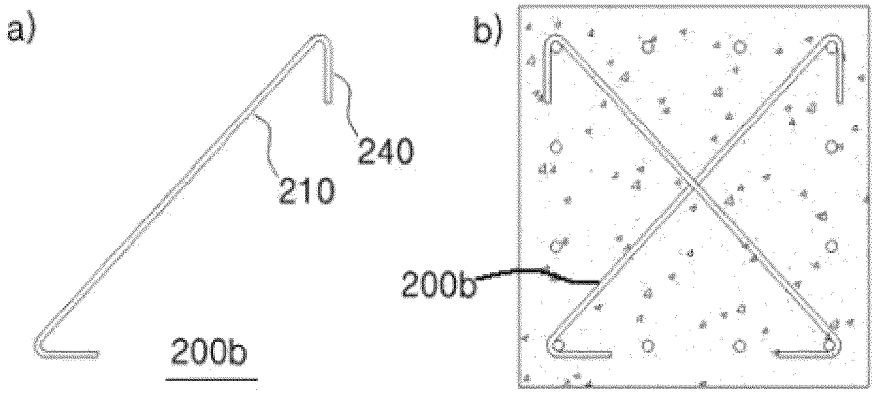

FIGS. 3 and 4 show an example of the support spacer 200.

The support spacer 200*a* of FIG. 3*a* is installed inside so as to support the main steel bars at corners in a diagonal direction, as in FIG. 3*b*.

The support spacer 200*a* is made up of bearing rings 220 for increasing an area of contact with the main steel bars and a linear body 210. A turnbuckle 230 is installed so as to be able to adjust a length of the support spacer. Here, the turnbuckle 230 is installed at both sides of the body 210 so as to be able to adjust the length of the support spacer at both sides or at one side of the body 210, so as to be able to adjust the length of the support spacer at one side only.

The support spacer 200*b* of FIG. 4*a* is installed inside so as to support the main steel bars at corners in a diagonal direction, as in FIG. 4*b*. The support spacer 200*b* of FIG. 4*a* is similar to that of FIG. 3*a* in that it is made up of a linear body 210, but is different in that fixtures 240 bent in a hook shape are fixed to the main steel bars.

Figure 5:
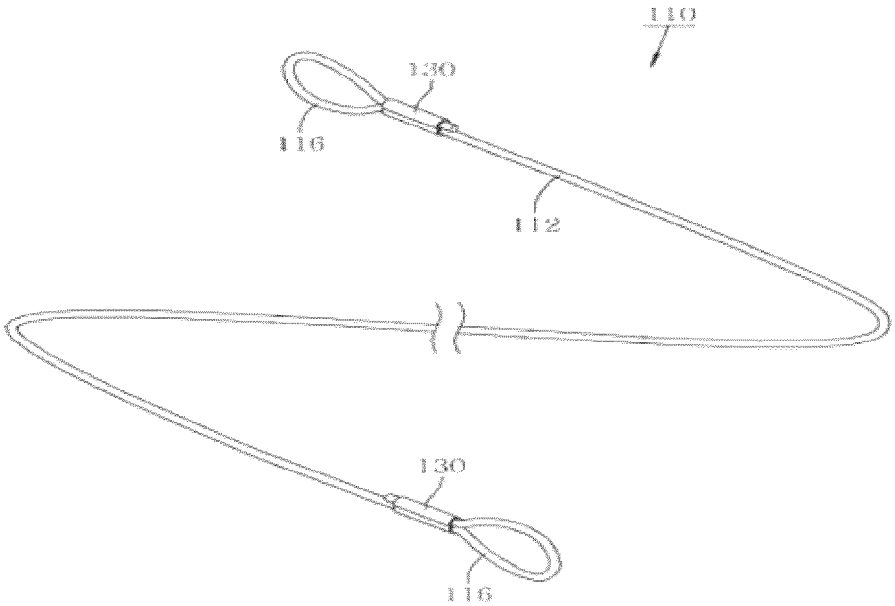
FIG. 5 shows a wire rope according to an embodiment of the present invention.

In the present invention, to shear-reinforce the main steel bars of the reinforced concrete structure using the wire ropes as transverse reinforcement arranging units, the wire rope 110 as shown in FIG. 5 is provided.

This wire rope 110 has a body 112 of a predetermined length. The body 112 is installed around the main steel bars of the reinforced concrete structure and is fixed to the main steel bars by eyes 116.

The wire rope 110 may perform the same as or better than a steel bar because it is lighter than an ordinary steel bar and has a much greater tensile strength than the steel bar, for instance, four times greater than the steel bar or two times greater than a composite material reinforcing bar. Further, the greatest advantage of wire rope 110 is that constructability is remarkably improved due to flexibility.

The eyes 116 of the wire rope 110 are formed in a closed loop shape by binding opposite ends thereof with clips 130 such as crimp sleeves. The eyes 116 may be fixedly bound by the clips 130 in consideration of load efficiency and convenience of machining the wire rope. That is, a method of forming each end of the wire rope 110 in a loop shape and crimping the end may be used.

Figure 6:
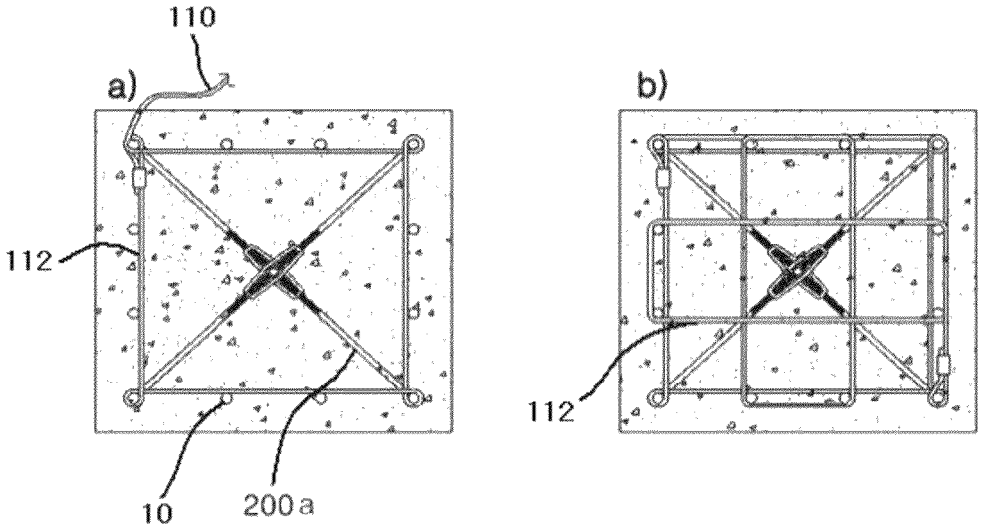
FIG. 6 is a cross-sectional view showing a state in which a wire rope and a support spacer are installed in accordance with a first embodiment of the present invention.

FIG. 6 is a cross-sectional view showing a state in which a wire rope 110 and support spacers 200*a* are installed in accordance with a first embodiment of the present invention.

First, the fiber cocktail made of the PP fiber and the steel fiber is mixed into the concrete.

Next, the support spacers 200*a* as described above are installed between the main steel bars at the corners of the reinforced concrete structure in a diagonal direction.

Finally, as shown in FIG. 6*a*, one of the eyes of the wire rope is fixed to one of the corner main steel bars 10, and the body 112 of the wire rope is arranged inside the main steel bars by winding each corner main steel bar one turn.

Continuously, as shown in FIG. 6*b*, the body 112 of the wire rope is wound around other main steel bars excluding the corner main steel bars in a closed shape, and then the other of the eyes of the wire rope is fixed to another corner main steel bar located diagonally across from the corner main steel bar to which the one of the eyes of the wire rope is fixed.

Here, the wire rope is wound in the closed shape so as to be able to transversely reinforce the main steel bars in various shapes such as a quadrilateral shape, a rhombic shape, or an octagonal shape.

Figure 7:
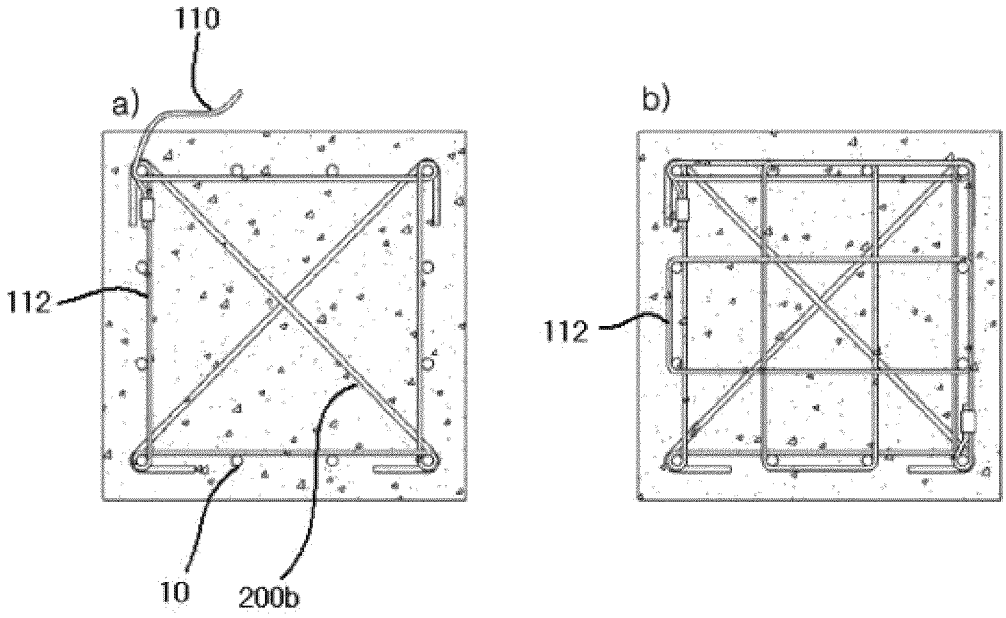
FIG. 7 is a cross-sectional view showing a state in which a wire rope and a support spacer are installed in accordance with a second embodiment of the present invention.

FIGS. 7*a* and 7*b* are cross-sectional views showing a state in which a wire rope and support spacers are installed in accordance with a second embodiment of the present invention.

The second embodiment is the same as the first embodiment except that support spacers 200*b* having the fixtures bent in the hook shape are installed in place of the support spacers 200*a*.

Figure 8:
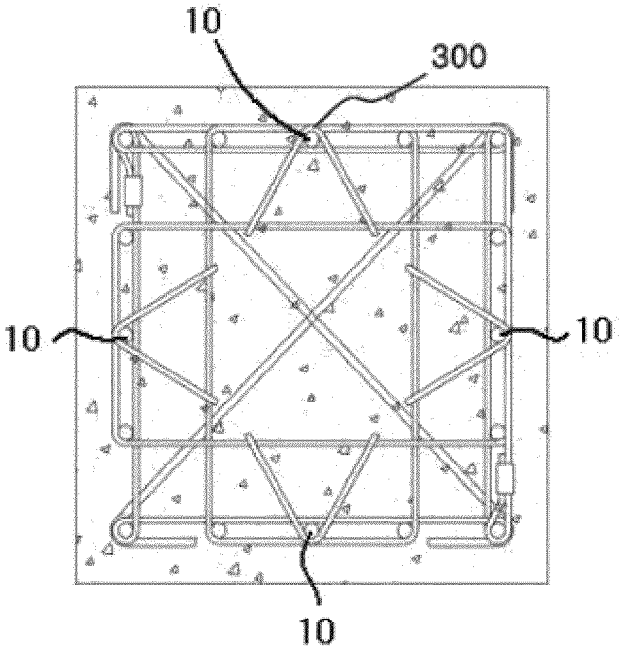
FIG. 8 is a cross-sectional view showing a state in which a wire rope and a support spacer are installed in accordance with a third embodiment of the present invention.

FIG. 8 is a cross-sectional view showing a state in which a wire rope, support spacers, and distance adjustors are installed in accordance with a third embodiment of the present invention.

As shown in FIG. 8, four main steel bars 10 located at inner middle points are kept unconfined by the wire rope. To bind the middle main steel bars, the V-shaped distance adjustors 300 are additionally installed so as to be widened toward an interior of the reinforced concrete structure and are able to reinforce proof stress of the main steel bars.

In another embodiment of the present invention, the main steel bars can be prevented from being widened and deformed using closed spacers in place of the support spacers as described above.

Figure 9:
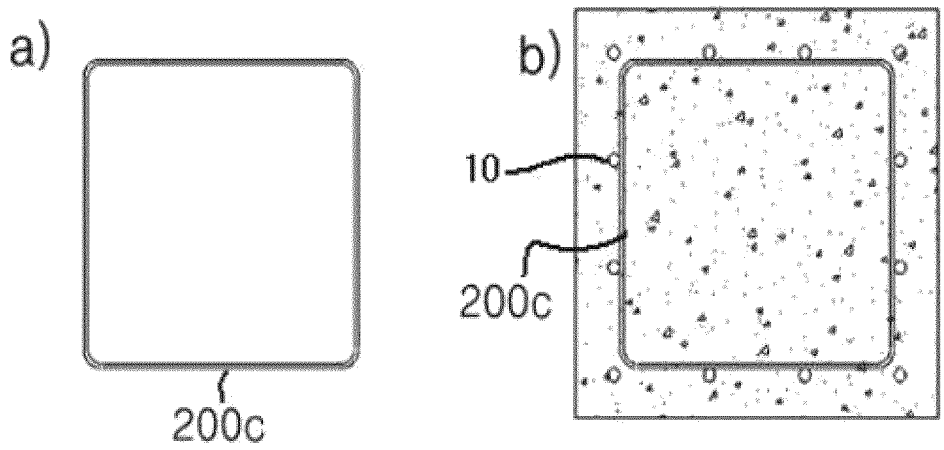
FIGS. 9 and 10 show a closed spacer according to other embodiments of the present invention.
Figure 10:
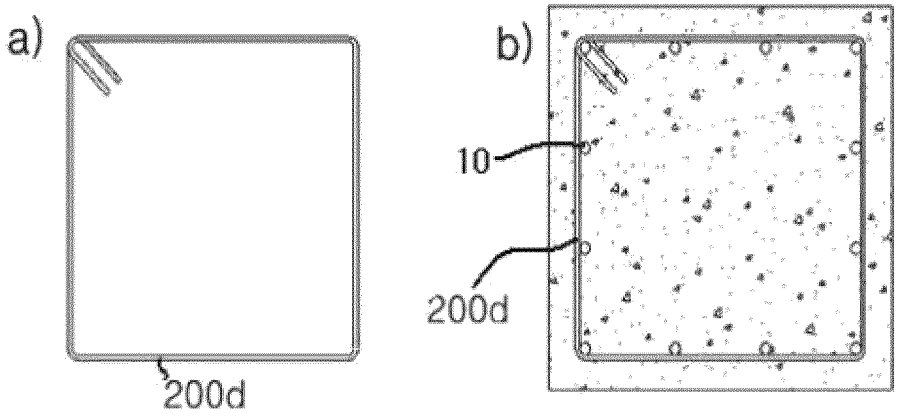

FIGS. 9 and 10 show examples of the closed spacer 200.

The closed spacer 200*c* of FIG. 9*a* is installed in a closed shape so as to support the main steel bars at an inner circumference connecting the main steel bars 10 as in FIG. 9*b*. The closed spacer 200*c* is formed in a closed shape by bonding opposite ends of a steel bar. Here, the closed spacers 200*c* may be disposed at intervals of 900 mm to 1500 mm.

The closed spacer 200*d* of FIG. 10*a* is installed in a closed shape so as to support the main steel bars at an outer circumference connecting the main steel bars 10 as in FIG. 10*b*. Here, the closed spacer 200*d* is equal to the closed spacer 200*c* in that it is formed in a closed shape by the steel bar, but it is fixed to one of the corner main steel bars by fixtures bent at opposite ends of the steel bar in a hook shape. Similarly, the closed spacers 200*d* may be disposed at intervals of 900 mm to 1500 mm.

Figure 11:
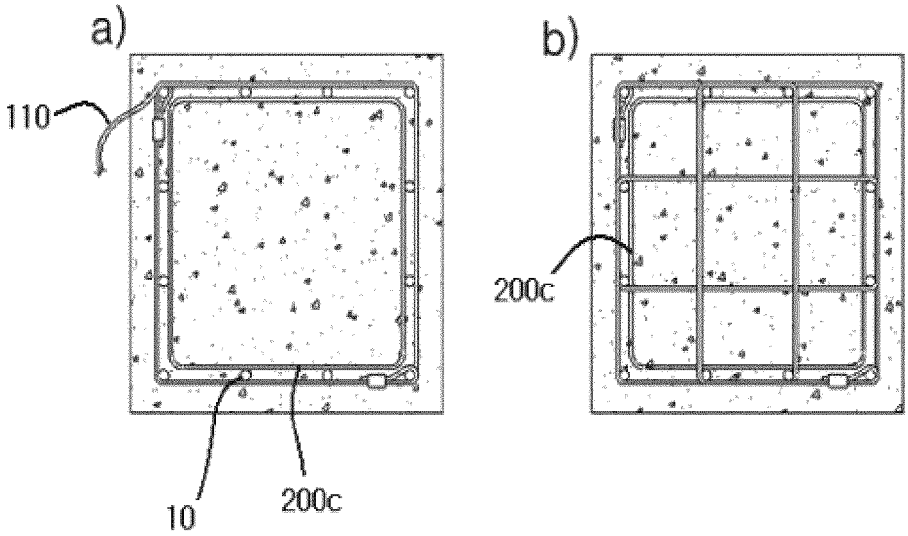
FIG. 11 is a cross-sectional view showing a state in which a wire rope and a closed spacer are installed in accordance with a fourth embodiment of the present invention.

FIG. 11 is a cross-sectional view showing a state in which a wire rope and closed spacers are installed in accordance with a fourth embodiment of the present invention.

First, the fiber cocktail made of the PP fiber and the steel fiber is mixed into the concrete.

Next, the support spacers 200*c* as described above are installed at the inner circumference connecting the main steel bars of the reinforced concrete structure.

Finally, as shown in FIG. 11*a*, one of the eyes of the wire rope is fixed to one of the corner main steel bars 10, and the body of the wire rope is wound around and arranged outside the main steel bars 10. As shown in FIG. 11*b*, the body of the wire rope is wound around other main steel bars excluding the corner main steel bars in a closed shape, and then the other of the eyes of the wire rope is fixed to another corner main steel bar located diagonally across from the corner main steel bar to which the one of the eyes of the wire rope is fixed.

Figure 12:
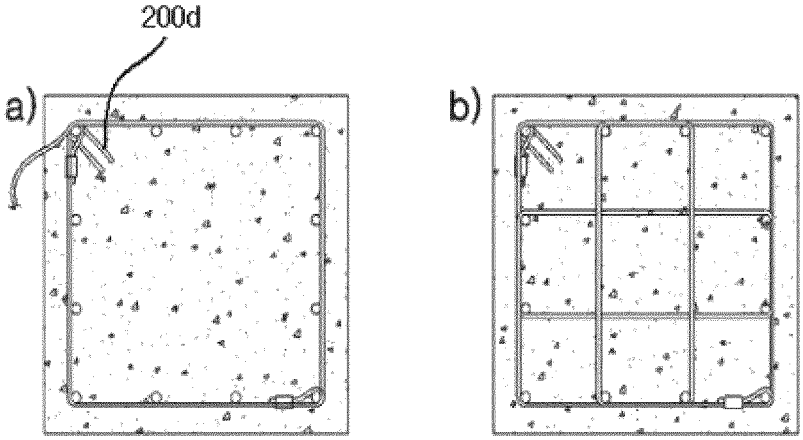
FIG. 12 is a cross-sectional view showing a state in which a wire rope and a closed spacer are installed in accordance with a fifth embodiment of the present invention.

FIG. 12 is a cross-sectional view showing a state in which a wire rope and closed spacers are installed in accordance with a fifth embodiment of the present invention.

The fifth embodiment is the same as the fourth embodiment except that the closed spacers 200*d* having the fixtures bent in the hook shape are installed at the outer circumference connecting the main steel bars of the reinforced concrete structure.

The aforementioned embodiments of the present invention may be used along with a conventional method of arranging tie bars. As an example, FIG. 13 shows an example in which a conventional tie bar arranging method and a wire rope arranging method are applied in combination in accordance with an embodiment of the present invention.

Figure 13:
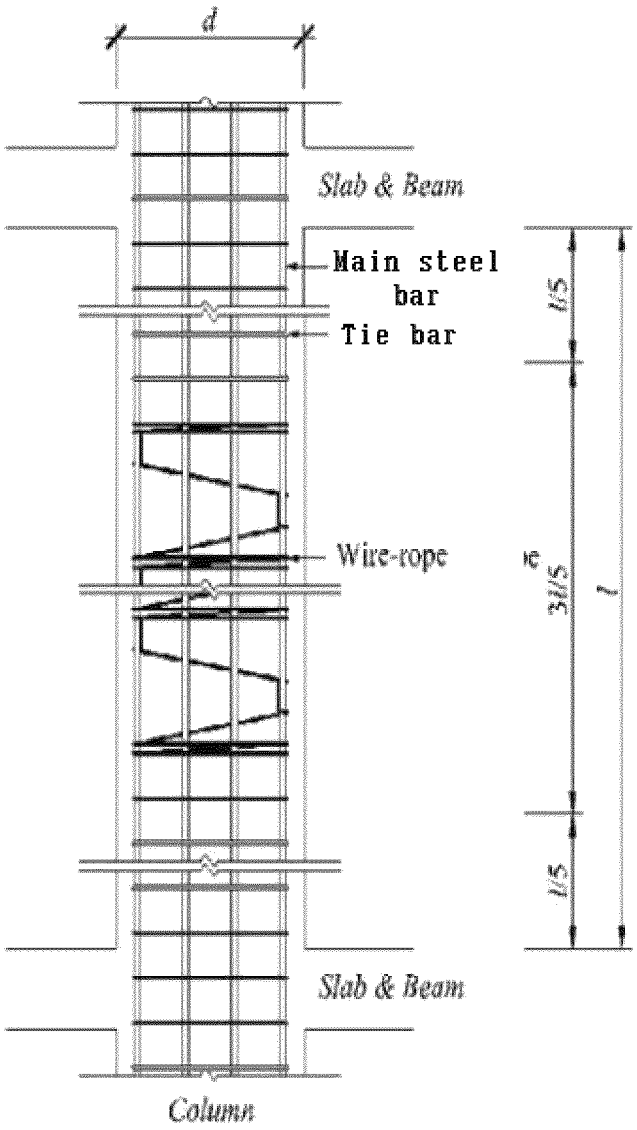
FIG. 13 shows an example in which a combination of a conventional construction method and a wire rope construction method are applied in accordance with an embodiment of the present invention.

Referring to FIG. 13, tie bars are arranged in upper and lower sections, each of which occupies (⅕)L of the net section L of a reinforced concrete structure in a conventional tie-bar arranging method, and a remaining intermediate section (⅗)L is transversely reinforced using a wire rope. Here, a method of arranging the wire rope may be applied to both a method of arranging the wire rope outside the main steel bars and a method of arranging the wire rope inside the main steel bars. Beams are connected to opposite ends (⅕)L of a column, and a transverse confining force is kept constant. Thus, the wire-rope and tie-bar arranging methods can be used together. Since the main steel bars can be constantly fixed in the upper and lower sections (⅕)L of the opposite ends in the conventional tie-bar arranging method, rendering construction using the wire rope in the intermediate section (⅗)L more stable.

In the methods according to embodiments of the present invention described up to now, the wire rope, the spacers, and the distance adjustors are easily installed compared to conventional shear steel bars, so that work efficiency is excellent.

Further, since the proof stress of the main steel bars can be reinforced by providing the transverse reinforcement using the wire rope and preventing buckling and deformation of the main steel bars using the spacers, fire resistance and earthquake resistance of the column can be secured.

Thus, the fire resistance of high-strength concrete can be effectively improved by improving the fire resistance based on the fiber cocktail and improving the structural performance of the main steel bars of the concrete structure.

Although exemplary embodiments of the present invention have been described, the present invention is not limited to these embodiments and various modifications, additions and substitutions are possible without departing from the scope and spirit of the invention as defined by the accompanying claims.

[Fire Test of High-Strength Fireproof Concrete Column]

A. MATERIAL PROPERTIES OF HIGH-STRENGTH FIREPROOF CONCRETE

To develop a method of constructing high-strength fireproof concrete based on a fiber mixture and wire rope reinforcement, high-strength fireproof concretes having compressive strengths of 60 MPa and 100 MPa were mixed as in Table 3, and properties of constituent materials used for the mixtures are given in Table 4.

The high-strength fireproof concretes were produced from a batch plant of H company according to strength-specific mixing tables of the high-strength fireproof concretes, and flow rates and air amounts of uncured concretes were measured. Then, the concretes were cured and their compressive strengths were measured. As a result, it could be confirmed that a compressive strength of a design strength or more could be secured, as shown in Table 5.

TABLE 3

| | | W/B | S/a | Air | Unit weight of material (kg/m³) | | | | | | | Ad. | Fiber (kg/m³) | |
|---|---|---|---|---|---|---|---|---|---|---|---|---|---|---|
| | | (wt %) | (vol %) | (wt %) | W | C | Slag | F/A | S/F | S | G | (kg/m³) | PP | Steel |
| 60 MPa | Unmixed | 26.2 | 46.0 | 2.0 | 165 | 572 | 163 | 82 | 0 | 639 | 759 | 8.19 | 0 | 0 |
| | Mixed | 26.2 | 46.0 | 2.0 | 165 | 572 | 163 | 82 | 0 | 639 | 759 | 9.45 | 1.5 | 40 |
| 100 MPa | Unmixed | 19.1 | 41.5 | 2.0 | 156 | 400 | 286 | 82 | 49 | 571 | 814 | 10.62 | 0 | 0 |
| | Mixed | 19.1 | 41.5 | 2.0 | 156 | 400 | 286 | 82 | 49 | 571 | 814 | 13.07 | 1.5 | 40 |

TABLE 4

| Material | Cement | Slag | Fly ash | Silica fume | Sand | Gravel | Admixture |
|---|---|---|---|---|---|---|---|
| Type | Type 1 (KS L 5201) | Type 3 (KS F 2563) | Type 1 (KS L 5405) | SF94 (ASTM C 1240) | Cleaned sand | Crushed gravel | Advanced AE water reducing agent |
| Specific gravity | 3.15 | 2.82 | 2.20 | 1.90 | 2.59 | 2.61 | — |
| Absorption rate | — | — | — | — | 0.70 | 0.60 | — |
| Particle size | — | — | — | — | 2.72 | 6.56 | — |

TABLE 5

| | | Strength (MPa) | | |
|---|---|---|---|---|
| | | 3 days | 7 days | 28 days |
| 60 MPa | Unmixed | 32.4 | 49.2 | 88.5 |
| | Mixed | 39.0 | 57.4 | 75.5 |
| 100 MPa | Unmixed | 66.7 | 92.7 | 104.5 |
| | Mixed | 67.4 | 92.3 | 112.0 |

B. TEST PLAN

To develop the method of constructing high-strength fireproof concrete based on a fiber mixture and wire rope reinforcement, an applied load and a load ratio were calculated with respect to column specimens having strengths of 60 MPa and 100 MPa, and the fire resistance test was performed on the column specimens having dimensions of 500×500×3000, as shown in Table 6.

TABLE 6

| Specimen | Variable (12) | Arrangement variable | Shape | Concrete strength | Steel bar | Tie bar [steel bar & wire rope] Volume ratio | Spacing (mm) | Confinement index | Load (ton) |
|---|---|---|---|---|---|---|---|---|---|
| S-1 | Non | General | 500 × | 60 MPa | Main | 0.00298 | 200 | 0.023 | 552 |
| S-2 | Wire | Composite | 500 × | | steel bar | 0.00291 | 43 | 0.023 | 552 |
| S-3 | Wire + Fiber | Composite | 3000 | | of | 0.00291 | 43 | 0.023 | 552 |
| S-4 | Non | General | | 100 MPa | 16- | 0.00298 | 200 | 0.014 | 737 |
| S-5 | Wire | Composite | | (granite | HD25 | 0.00291 | 43 | 0.014 | 737 |
| S-6 | Wire + Fiber | Composite | | aggregate) | Cladding of 40 mm | 0.00291 | 43 | 0.014 | 737 |

An actual fire test was performed by realizing fixed end conditions using bolts and steel sections under heating conditions to simulate standard fire (ISO fire) conditions based on KS F 2257-1, and on two-end boundary conditions of the column which were the same as the actual structure.

Figure 14:
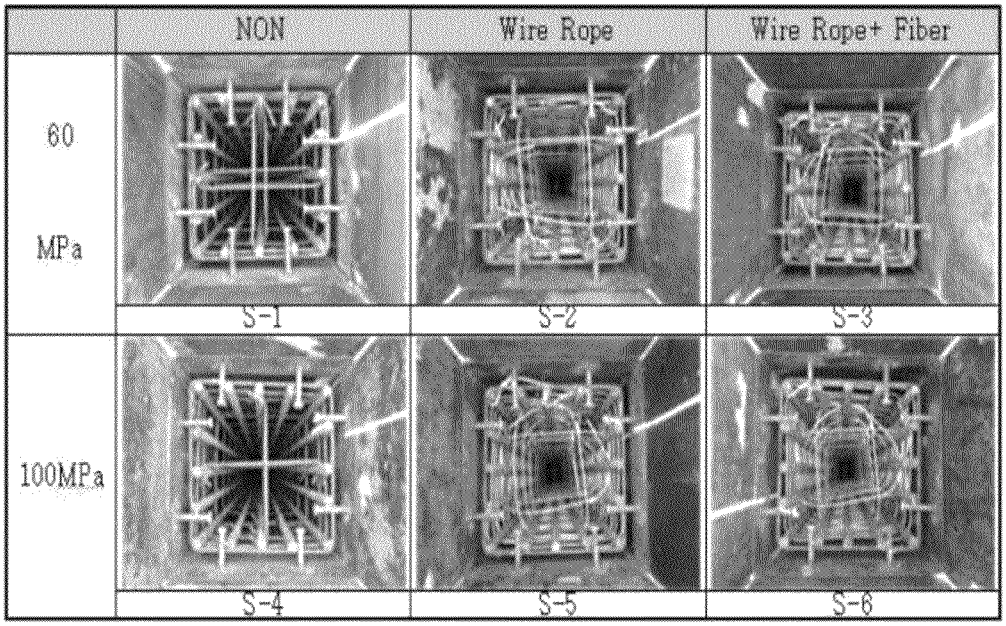
FIG. 14 is a manufacturing view according to an embodiment of the present invention.

The high-strength fireproof concrete column specimens based on the fiber mixture and the wire rope reinforcement were manufactured as in FIG. 14.

C. TEST RESULTS (1) Temperature Estimation

As a result of performing the fire resistance test (temperature estimation) on the column specimens having strengths of 60 MPa and 100 MPa to develop the method of constructing high-strength fireproof concrete based on a fiber mixture and wire rope reinforcement, average and maximum temperatures of the steel bars according to application of the method were measured as shown in Table 7.

TABLE 7

| | | Time (min) | Average temperature of steel bars (° C.) | Maximum temperature of steel bars (° C.) |
|---|---|---|---|---|
| 60 MPa | Non (S-1) | 60 | 309.2 | 563.4 |
| | | 120 | 1140.4 | 1185.4 |
| | | 146 | 1227.0 | 1281.7 |
| | Wire (S-2) | 60 | 184.8 | 256.5 |
| | | 120 | 512.6 | 639.6 |
| | | 180 | 1115.9 | 1180.7 |
| | Wire + | 60 | 151.5 | 162.9 |
| | Fiber (S-3) | 120 | 1040.0 | 1053.7 |
| | | 180 | 1120.2 | 1165.8 |
| 100 MPa | Non (S-4) | 43 | 394.8 | 537.6 |
| | | 120 | — | — |
| | | 180 | — | — |
| | Wire (S-5) | 60 | 487.3 | 642.4 |
| | | 69 | 541.9 | 732.7 |
| | | 180 | — | — |

TABLE 7-continued

| | | Time (min) | Average temperature of steel bars (° C.) | Maximum temperature of steel bars (° C.) |
|---|---|---|---|---|
| | Wire + | 60 | 272.1 | 328.4 |
| | Fiber (S-6) | 120 | 573.1 | 608.1 |
| | | 180 | 1223.9 | 1370.0 |

(2) Fire Resistance Estimation

As a result of performing the fire resistance test (shrinking estimation) on the column specimens having strengths of 60 MPa and 100 MPa to develop the method of constructing high-strength fireproof concrete based on a fiber mixture and wire rope reinforcement, shrinkages and shrinking rates of the specimens according to the application of the method were measured as shown in Table 7.

TABLE 8

| | | Time (min) | Shrinkage (mm) | Shrinkage rate (mm/min) | Final fire resistance (min) |
|---|---|---|---|---|---|
| 60 MPa | Non (S-1) | 60 | 1.5 | 0.03 | 146 |
| | | 120 | 0.7 | −0.02 | |
| | | 147 | −42.6 | −38.08 | |
| | Wire (S-2) | 60 | 2.3 | 0.02 | 180 |
| | | 120 | 2.9 | −0.02 | |
| | | 180 | 0.1 | −0.05 | |
| | Wire + Fiber (S-3) | 60 | 1.9 | 0.05 | 180 |
| | | 120 | 3.5 | 0.03 | |
| | | 180 | 4.5 | 0.01 | |
| 100 MPa | Non (S-4) | 44 | −35.6 | −30.83 | 43 |
| | | 120 | — | — | |
| | | 180 | — | — | |
| | Wire (S-5) | 60 | −0.2 | −0.13 | 69 |
| | | 69 | −4.5 | −3.01 | |
| | | 180 | — | — | |
| | Wire + Fiber (S-6) | 60 | 2.2 | 0.03 | 180 |
| | | 120 | 3.8 | −0.01 | |
| | | 180 | 3.7 | −0.03 | |

As a result of performing the fire resistance test, maximum spalling depths and weight losses of the column specimens showed that spalling was reduced more in the specimens to which the method was applied compared to the specimens to which the method was not applied, as shown in Table 9.

TABLE 9

| | | Maximum spalling depth (mm) | Weight | | | Final fire resistance (min) |
|---|---|---|---|---|---|---|
| | | | Before test (kg) | After test (kg) | Reduction rate (%) | |
| 60 MPa | Non (S-1) | 76 | 2160 | 1720 | 20 | 146 |
| | Wire (S-2) | 58 | 2200 | 1830 | 17 | 180 |
| | Wire + Fiber (S-3) | 0 | 2130 | 2010 | 6 | 180 |
| 100 MPa | Non (S-4) | 87 | 2230 | 1530 | 31 | 43 |
| | Wire (S-5) | 68 | 2200 | 1580 | 28 | 69 |
| | Wire + Fiber (S-6) | 28 | 2240 | 1870 | 17 | 180 |

Figure 15:
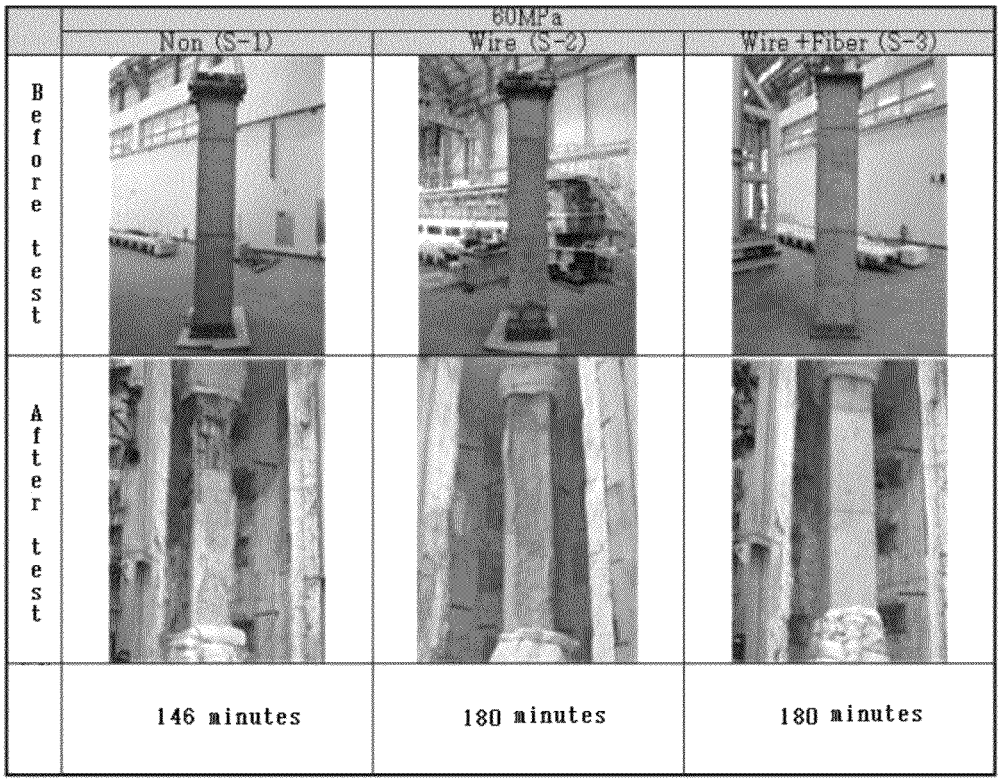
FIGS. 15 and 16 show results of performing a fire resistance test according to the present invention.
Figure 16:
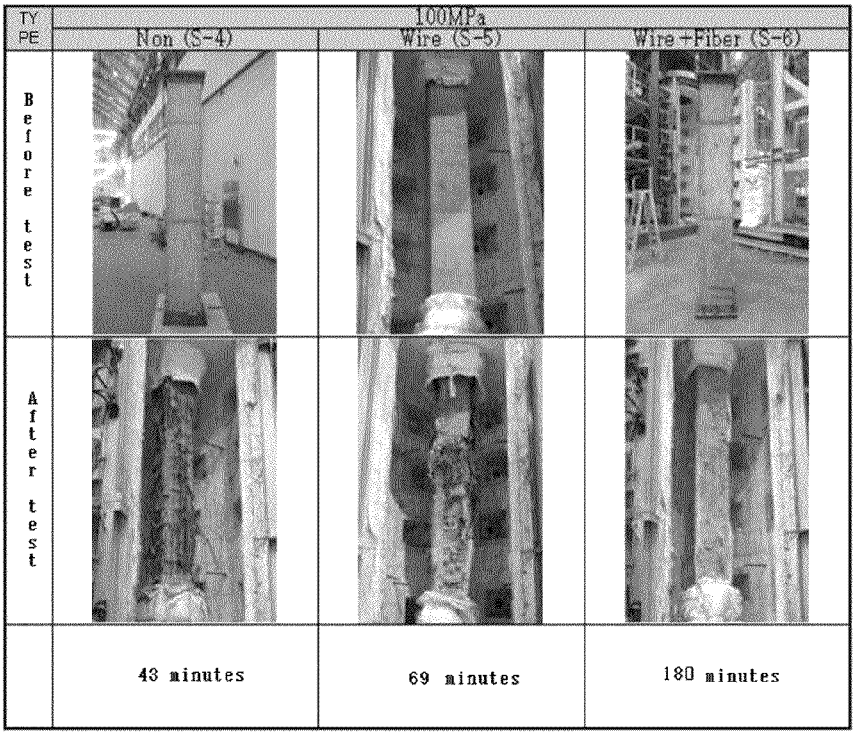

To develop the method of constructing high-strength fireproof concrete to which fiber mixture and wire rope reinforcement were applied, post-fire damage resulting from performing the fire resistance test under ISO fire conditions is shown in FIGS. 15 and 16.

Figure 17:
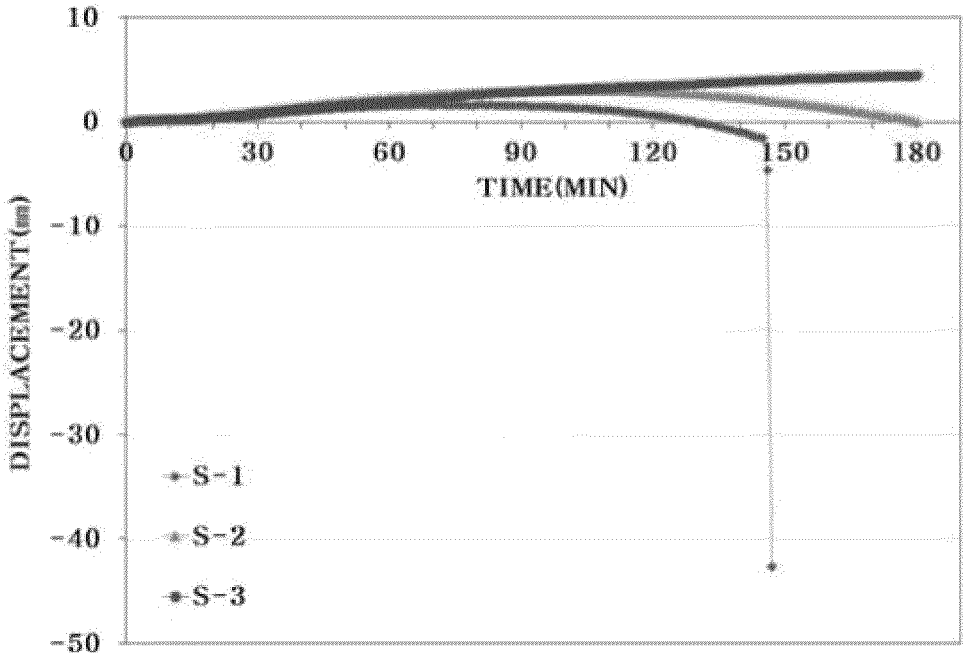
FIG. 17 is a graph showing shrinkage of specimens as a result of performing a fire resistance test on fireproof concrete column specimens having a strength of 60 MPa in the present invention.

(3) Fire Resistance Estimation of High-Strength Concrete Column Having Strength of 60 MPa Shrinkages of the specimen resulting from performing the fire resistance test on the fireproof concrete column specimen having a strength of 60 MPa is shown in FIG. 17. In the case of specimen S-2 to which only the wire rope was applied, the transverse confining force of the steel bars based on the wire rope was continuously maintained in the event of a fire, unlike the typical tie bar construction method, and thus it was shown that S-2 had a fire resistance of 180 minutes. As a result of analyzing the shrinkage of specimen S-1 to which the fire resistance securing method was not applied, and the shrinkage of specimen S-3 to which the method of mixing the wire rope and the fiber cocktail was applied, it was shown that S-1 underwent shrinkage that exceeded an allowable deformation and an allowable strain at 147 minutes, and that S-3 did not exceed the allowable deformation and the allowable strain up to 180 minutes. Thus, the fireproof concrete column specimen having a strength of 60 MPa had a fire resistance of 180 minutes when the method of improving the transverse confining force of the wire rope of the high-strength concrete wherein only the wire rope within a volume of the tie bar was used in place of the tie bar was applied.

Figure 18:
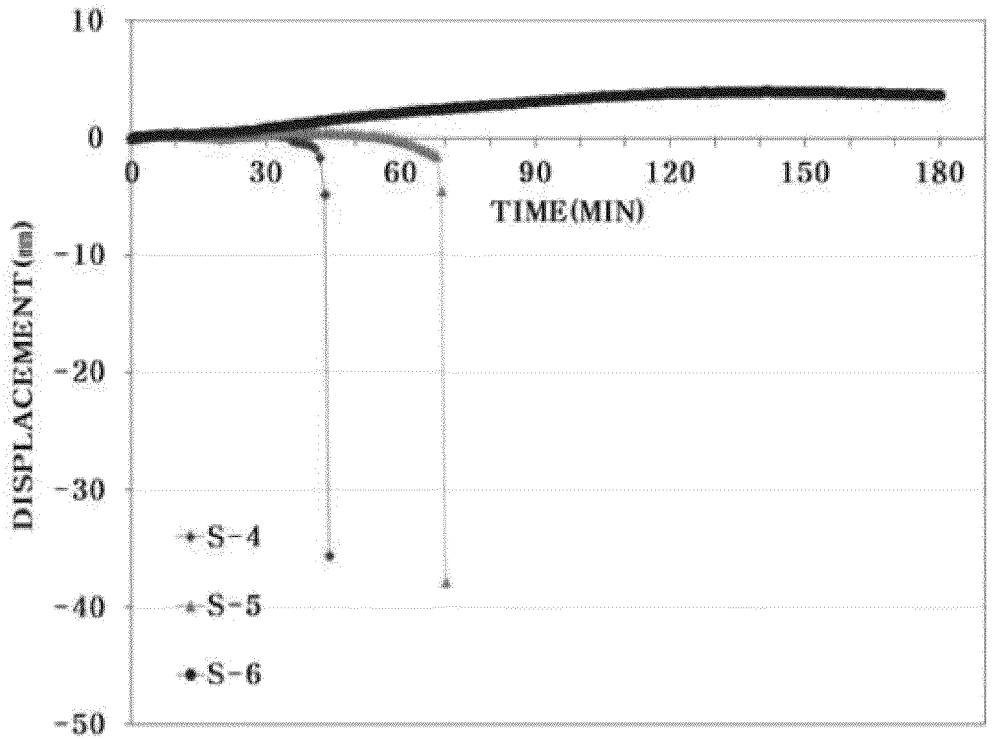
FIG. 18 is a graph showing shrinkage of specimens as a result of performing a fire resistance test on fireproof concrete column specimens having a strength of 100 MPa in the present invention.

(4) Fire Resistance Estimation of High-Strength Concrete Column Having Strength of 100 MPa Shrinkage of the specimen resulting from performing the fire resistance test on the fireproof concrete column specimen having a strength of 100 MPa is shown in FIG. 18. In the case of specimen S-5 to which only the method of improving the transverse confining force of the wire rope was applied, it was shown that S-5 had a fire resistance of 26 minutes compared to specimen S-4 to which the fireproof construction method was not applied at the same strength. In the case of S-4 to which the fireproof construction method was not applied, it was concluded that the specimen could not be applied in construction since it exhibited a fire resistance of less than 60 minutes. However, when the transverse confinement construction method using the wire rope having the same volume is applied in place of the existing tie bar construction method, a fire resistance of 60 minutes or more could be secured, so that the specimen could be applied to buildings of four stories or less.

As a result of analyzing the shrinkage of specimen S-4 to which the fireproof construction method was not applied and the shrinkage of specimen S-6 to which the method of mixing the wire rope and the fiber cocktail was applied, it was shown that S-4 underwent shrinkage that exceeded an allowable deformation and an allowable strain at 44 minutes, and that S-6 did not exceed the allowable deformation and the allowable strain up to 180 minutes. Thus, when the fiber cocktail was additionally mixed with the wire rope reinforcing method, which was the existing plan for improving the transverse confining force of the steel bars, the fireproof concrete column specimen could secure a fire resistance of 180 minutes, meaning it could be applied to all buildings of 14 stories or more.

D. CONCLUSIONS

In the present invention, the fire resistance test was performed on the column specimens which had strengths of 60 MPa and 100 MPa and were used to develop the method of constructing high-strength fireproof concrete based on a fiber mixture and wire rope reinforcement, under ISO fire conditions, and the fire resistance based on KS F 2257-1 was estimated. It was concluded that the results could be used as basic data for on-the-spot application of the high-strength fireproof concrete. Main research results were as follows.

(1) As a result of determining the fire resistance of the column member based on the KS F 2257-1 standard, a fire resistance of 146 minutes was obtained in the case of specimen S-1 which had a strength of 60 MPa and to which no construction method was applied. S-1 could be applied to buildings of 12 stories or less as a column that could support 552 tons.

(2) When the wire rope construction method in which the tie bars were replaced with the wire rope at the same volume ratio in the high-strength concrete column having a strength of 60 MPa was used as the steel bar transverse confinement construction method, the high-strength concrete column could secure a fire resistance of 180 minutes, meaning that it could be applied to buildings of 12 stories or more as a column capable of supporting 552 tons without separate fireproofing treatment.

(3) When the wire rope construction method in which the tie bars were replaced with the wire rope at the same volume ratio in the high-strength concrete column having a strength of 60 MPa was mixed with the fiber cocktail construction method for preventing spalling, the high-strength concrete column could secure a fire resistance of 180 minutes, meaning that it could be applied to buildings of 12 stories or more as a column capable of supporting 552 tons without separate fireproofing treatment.

(4) As a result of determining the fire resistance of the column member based on the KS F 2257-1 standard, it was shown that a fire resistance of 43 minutes was obtained in the case of specimen S-4 which had a strength of 100 MPa and to which no construction method was applied. S-4 could not be applied as a fireproof structure.

(5) When the wire rope construction method in which the tie bars were replaced with the wire rope at the same volume ratio in the high-strength concrete column having a strength of 60 MPa was used as the steel bar transverse confinement construction method, the high-strength concrete column could secure a fire resistance of 69 minutes. Thus, it could be applied to buildings of 4 stories or more as a column capable of supporting 552 tons without separate fireproofing treatment.

(6) When the wire rope construction method in which the tie bars were replaced with the wire rope at the same volume ratio in the high-strength concrete column having a strength of 60 MPa was mixed with the fiber cocktail construction method for preventing spalling, the high-strength concrete column could secure a fire resistance of 180 minutes. Thus, it could be applied to buildings of 12 stories or more as a column capable of supporting 737 tons without separate fireproofing treatment.

It will be apparent to those skilled in the art that various modifications can be made to the above-described exemplary embodiments of the present invention without departing from the spirit or scope of the invention. Thus, it is intended that the present invention covers all such modifications provided they fall within the scope of the appended claims and their equivalents.

What is claimed is:

1. A method of enhancing fire resistance of high-strength concrete, comprising: mixing a fiber cocktail, which is a hybrid of a polypropylene fiber and a steel fiber, into the high-strength concrete; installing support spacers between corner main steel bars of a reinforced concrete structure in a diagonal direction; fixing one of eyes of a wire rope, which are formed by binding opposite ends of a body of the wire rope with clips in a loop shape, to one of the corner main steel bars, winding the body of the wire rope around each corner main steel bar one turn so that the body of the wire rope is disposed inside the other main steel bars, winding the body of the wire rope around other main steel bars excluding the corner main steel bars in a closed shape, and fixing the other of the eyes of the wire rope to another corner main steel bar located diagonally across from the corner main steel bar to which the one of the eyes of the wire rope is fixed.

2. The method of claim 1, wherein each of the support spacers includes a linear body, bearing rings formed at opposite ends of the linear body, and a turnbuckle installed in a middle thereof so as to be able to adjust a length of the linear body.

3. The method of claim 1, wherein each of the support spacers includes a linear body, and fixtures bent at opposite ends of the linear body in a hook shape.

4. The method of claim 1, wherein the polypropylene fiber of the high-strength concrete is mixed in at a concentration of 1.4 kg/m3 to 1.6 kg/m3.

5. The method of claim 1, wherein the polypropylene fiber is mixed in such a manner that two polypropylene fibers having different diameters are mixed in at a mixing ratio of 7:3 to 5:5.

6. The method of claim 1, further comprising installing V-shaped distance adjustors on the middle main steel bars that are not confined by the wire rope.

7. The method of claim 1, wherein the reinforced concrete structure has tie bars arranged in upper and lower sections thereof, each of which occupies (⅕)L of a net section L thereof, and the wire rope is wound in a remaining intermediate section (⅗)L thereof.

* * * * *